US006553912B2

(12) United States Patent
Wygant

(10) Patent No.: US 6,553,912 B2
(45) Date of Patent: Apr. 29, 2003

(54) WAR GAMES LAND MINE

(75) Inventor: Steven J. Wygant, Syracuse, IN (US)

(73) Assignee: Blackpoint Engineering, LLC, Goshen, IN (US)

( * ) Notice: Subject to any disclaimer, the term of this patent is extended or adjusted under 35 U.S.C. 154(b) by 24 days.

(21) Appl. No.: 09/829,089

(22) Filed: Apr. 9, 2001

(65) Prior Publication Data

US 2002/0166474 A1 Nov. 14, 2002

(51) Int. Cl.[7] ..... F42B 8/00

(52) U.S. Cl. ..... 102/498; 102/334; 102/364; 102/367; 102/401; 102/513; 222/5; 434/11

(58) Field of Search ..... 102/334, 357, 102/364–368, 395, 401, 440, 498, 502, 513, 529; 222/5, 389; 434/11

(56) References Cited

U.S. PATENT DOCUMENTS

| | | | | | |
|---|---|---|---|---|---|
| 3,380,383 | A | * | 4/1968 | Schnepfe, Jr. | 102/364 |
| 3,492,945 | A | * | 2/1970 | Filippi | 102/498 |
| 3,762,330 | A | * | 10/1973 | Hall | 102/482 |
| 4,690,061 | A | | 9/1987 | Armer, Jr. et al. | 102/401 |
| 4,932,329 | A | | 6/1990 | Logie | 102/498 |
| 4,944,521 | A | * | 7/1990 | Greeno | 102/513 |
| 5,018,449 | A | | 5/1991 | Eidson, II | 102/498 |
| D366,283 | S | | 1/1996 | Fernandes | D21/2 |
| 5,877,448 | A | | 3/1999 | Denton et al. | 102/401 |
| 5,936,183 | A | | 8/1999 | McNulty, Sr. | 89/1.11 |
| 5,996,503 | A | | 12/1999 | Woodall et al. | 102/498 |
| 6,453,819 | B1 | * | 9/2002 | Coates | 102/498 |

FOREIGN PATENT DOCUMENTS

| | | | | |
|---|---|---|---|---|
| FR | 2642160 | * | 7/1990 | 102/365 |

* cited by examiner

*Primary Examiner*—Harold J. Tudor
(74) *Attorney, Agent, or Firm*—Taylor & Aust, P.C.

(57) ABSTRACT

A war games land mine includes a fluid supply mechanism, a housing and a sealing device. The fluid supply mechanism is configured for containing and selectively releasing therefrom a pressurized fluid. The housing has an interior surface, a first orifice and a second orifice, the first orifice of the housing being fluidly coupled with the fluid supply mechanism. The sealing device is movably mounted within the housing, the sealing device having a first side and a second side. The first side and the interior surface of the housing define a first chamber therebetween, the first chamber being fluidly coupled with the first orifice. The second side and the interior surface defining a second chamber therebetween, the second chamber being fluidly coupled with the second orifice and configured for being substantially filled with a marking agent. The sealing device is configured for being moved within the housing upon release of the pressurized fluid from the fluid supply mechanism to thereby eject the marking agent through the second orifice.

14 Claims, 9 Drawing Sheets

WAR GAMES LAND MINE

BACKGROUND OF THE INVENTION

1. Field of the Invention

The present invention relates to a war games land mine, and, more particularly, to a war games land mine which uses the release of a gas under pressure to cause the discharge of a marking agent.

2. Description of the Related Art

War games land mines are currently available for use in simulated war games. Such war games land mines typically incorporate some form of a marking agent such as paint or water. Several of these war games land mines generate the force needed to disperse the marking agent by piercing of a $CO_2$ cartridge, with the $CO_2$ directly impacting upon the marking agent. Such a system presents a problem in that the marking agent is not fluidly separated from the actuator/piercing mechanism, allowing the marking agent to potentially contaminate this mechanism and other areas of the land mine.

SUMMARY OF THE INVENTION

The present invention relates to a war games land mine which uses a piston within a cylinder arrangement to discharge the marking agent through a discharge nozzle and to thereby fluidly separate the marking agent from the actuator/piercing mechanism and prevent contamination of other portions of the war games land mine.

The invention comprises, in one form thereof, a war games land mine including a fluid supply mechanism, a housing and a sealing device. The fluid supply mechanism is configured for containing and selectively releasing therefrom a pressurized fluid. The housing has an interior surface, a first orifice and a second orifice, the first orifice of the housing being fluidly coupled with the fluid supply mechanism. The sealing device is movably mounted within the housing, the sealing device having a first side and a second side. The first side and the interior surface of the housing define a first chamber therebetween, the first chamber being fluidly coupled with the first orifice. The second side and the interior surface defining a second chamber therebetween, the second chamber being fluidly coupled with the second orifice and configured for being substantially filled with a marking agent. The sealing device is configured for being moved within the housing upon release of the pressurized fluid from the fluid supply mechanism to thereby eject the marking agent through the second orifice.

An advantage of the present invention is that the marking agent is maintained fluidly separate from the gas-source module, including the trigger assembly, preventing the contamination thereof with the marking agent.

A further advantage of the present invention is that the impact of pressurized fluid upon the piston promotes steady and even dispersal of the marking agent through the nozzle.

Another advantage of the present invention is that both refillable and disposable marking agent containment systems are available for use therewith.

An additional advantage of the present invention is that the gas-source module can be adapted to use various sources of pressurized gas, including gas cartridges, large bottles of gas and air compression systems, or other pressurized fluid.

A yet another advantage is that any of a variety of marking agent release activators may be used, including, but not necessarily limited to, a trip wire, a motion sensor, a proximity sensor, a radio frequency receiver/transceiver, a timer and an electronic controller.

A further advantage is that the device can be provided with a manual reset device for each of the piercer driver/hammer and the piston.

A yet further advantage is that any of a variety of marking agents may be used including, but not necessarily limited to, paint and water.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
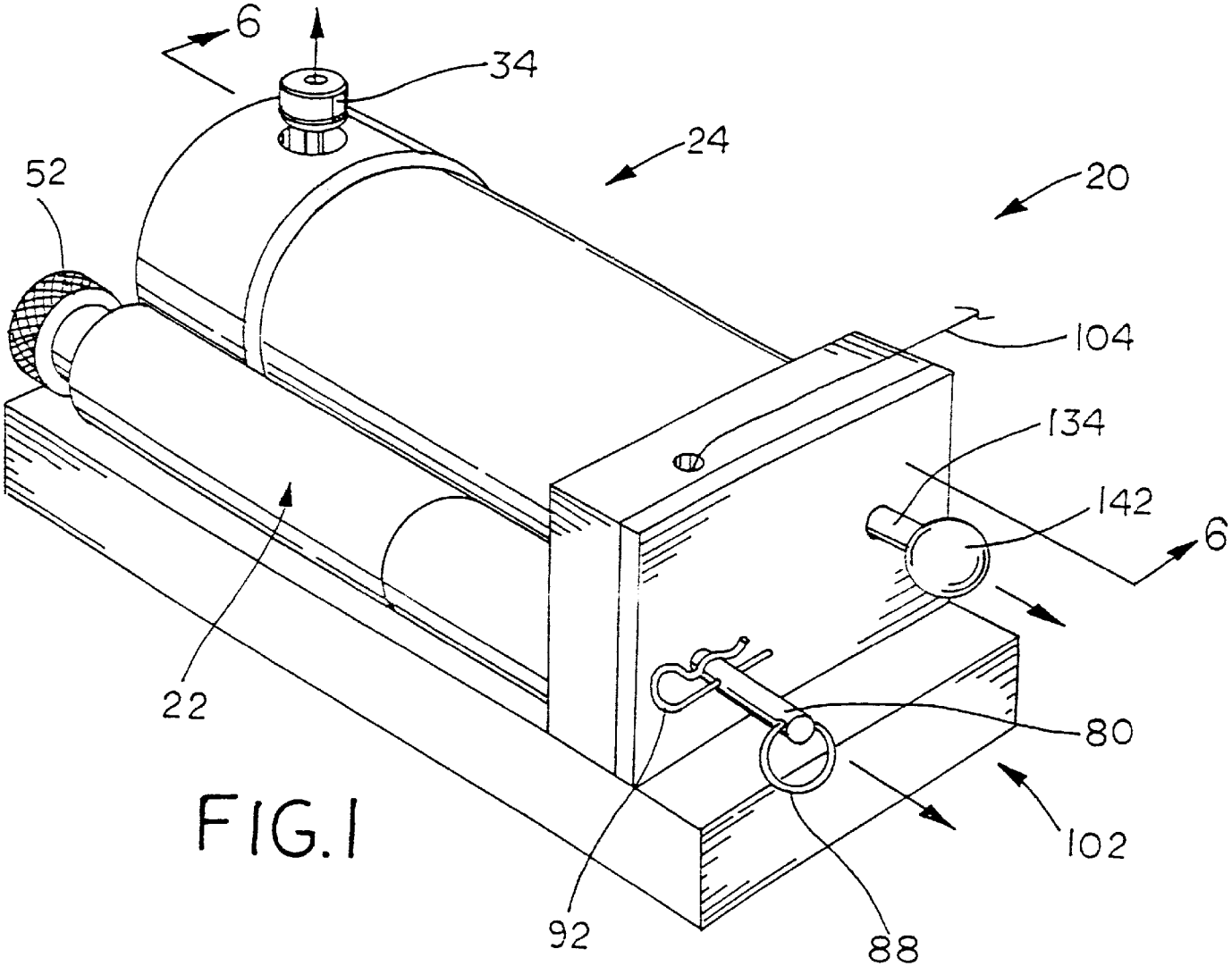
FIG. 1 is an isometric view of a first embodiment of a war games land mine of the present invention.

Corresponding reference characters indicate corresponding parts throughout the several views. The exemplifications set out herein illustrate at least one preferred embodiment of the invention, in one form, and such exemplifications are not to be construed as limiting the scope of the invention in any manner.

DETAILED DESCRIPTION OF THE INVENTION

Figure 2:
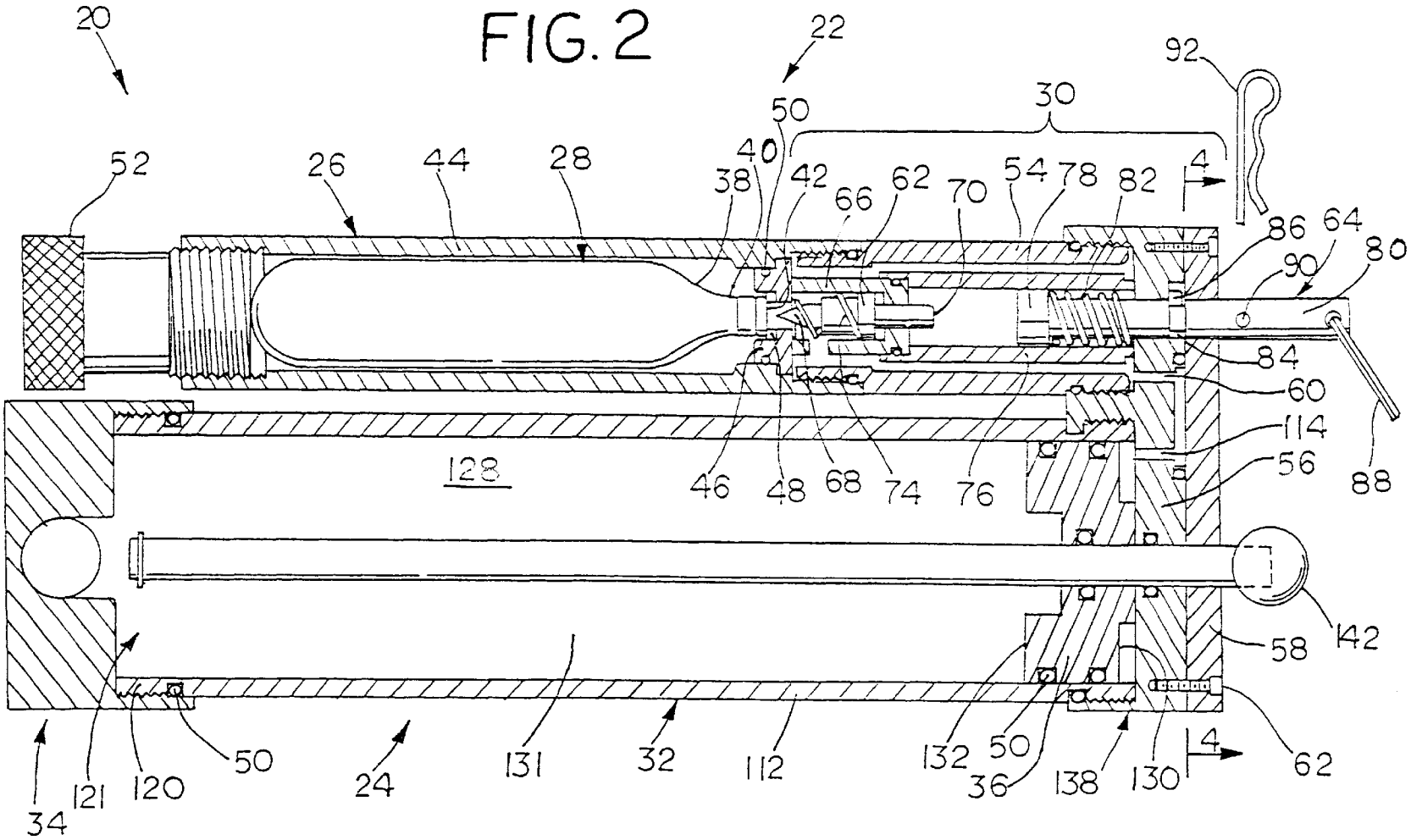
FIG. 2 is a cut-away view of a war games land mine of FIG. 1 of the present invention in a loaded or unfired position.
Figure 3:
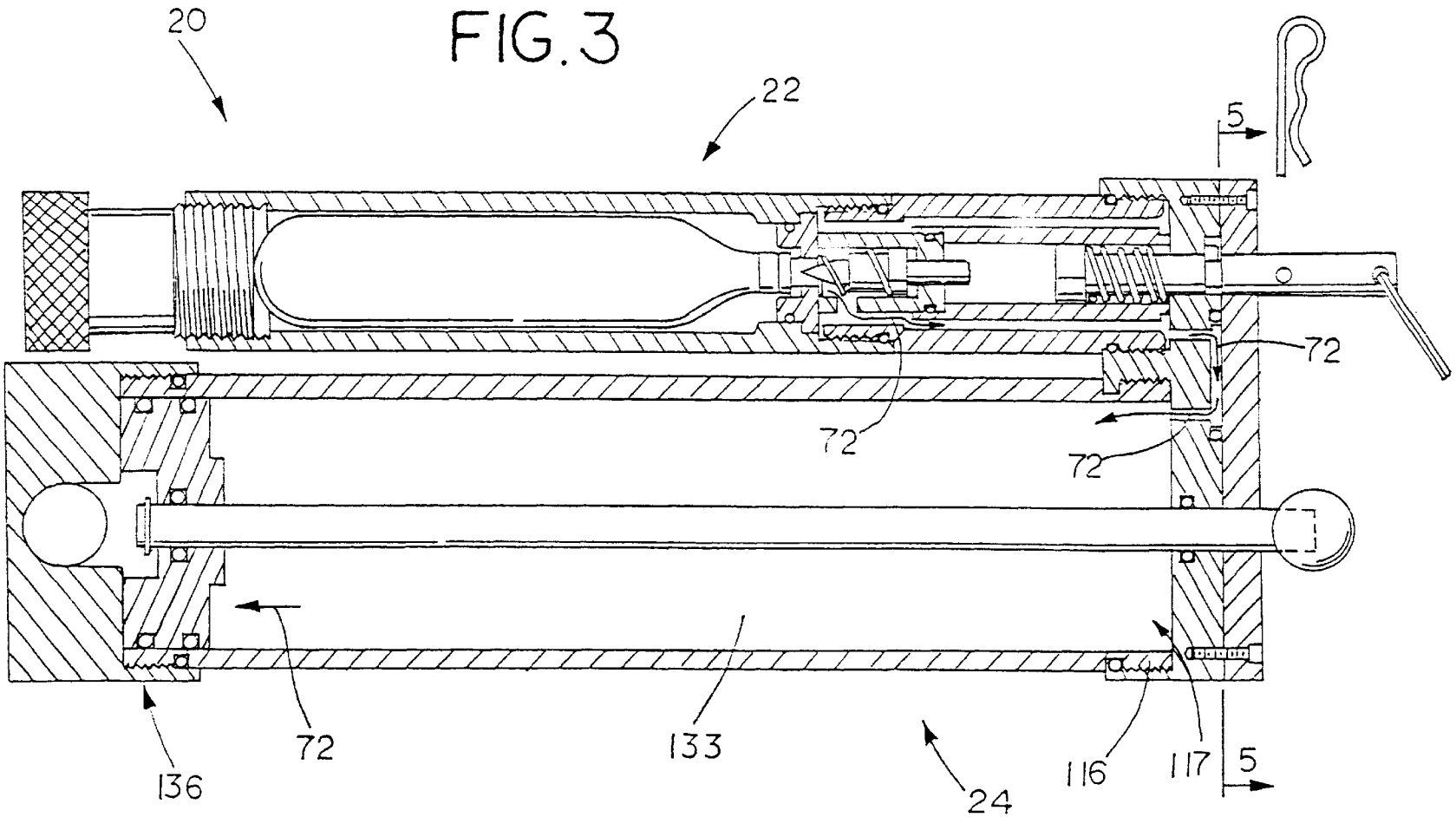
FIG. 3 is a cut-away view of a first embodiment of a war games land mine of the present invention in an as-fired position.

Referring now to the drawings, and more particularly to FIGS. 1–3, there is shown a war games land mine 20 which generally includes a gas-release module 22 and a marker-source module 24. Gas-release module 22 further includes a gas source 28 and a trigger assembly 30. Marker-source module 24 further includes a marker-source module housing 32, a delivery nozzle 34 and a piston 36.

Gas source 28 is a source of a gas under pressure. Gas source 28 is preferably a gas cartridge 38 filled with carbon dioxide or air. Gas cartridge 38 has a neck 40 with a sealed opening 42 at the end thereof Alternatively, gas source 28 may be a compressed gas source (not shown) such as a larger bottle or compressed air system using a valve to selectively release the gas therein. The primary function of gas source 28 is to provide a fluid under pressure that can be selectively released and eventually impinge upon piston 36. Consequently, it is contemplated that any pressurized fluid, such as a pressurized liquid, could be provided to fulfill this function.

Gas-release module housing 26 includes housing elements for both gas source 28 and trigger assembly 30. Specifically, gas-release module housing 26 includes gas cartridge receiver 44 into which gas cartridge 38 is inserted. Neck 40 of gas cartridge 38 is positioned within cartridge seat 46. Sealed opening 42 of neck 40 abuts against seal 48, seal 48 being composed of polytetraflouroethylene (PTFE). Cartridge seat 46 is sealingly held in contact with gas cartridge receiver 44 by an O-ring 50. O-rings 50 are used throughout war games land mine 20 for purposes of sealingly retaining fluid materials within war games land mine 20 and/or holding contacting parts together, a portion of such O-rings 50 being labeled. Gas cartridge 38 is releasably held within gas cartridge receiver 44 by a cartridge cap 52. Preferably, cartridge cap 52 may be screwed into gas cartridge receiver 44.

Gas-release module housing 26 further includes a main trigger housing 54, a manifold 56 and a manifold lid 58 for collectively containing trigger assembly 30. Main trigger housing 54, manifold 56 and manifold lid 58 together define a first gas channel 60 for channeling gas from gas source 28 toward marker-source module 24. Manifold lid 58 is attached to manifold 56 by manifold mounting bolts 62 (one of which is labeled). Main trigger housing 54 is sealingly mounted between gas cartridge receiver 44 and manifold 56.

Trigger assembly 30 includes, in the embodiment shown in FIGS. 1–3, a piercer 62 and a hammer 64, which acts as a piercer driver. Piercer 62 is mounted in piercer housing 66, piercer housing 66 being positioned within main trigger housing 54. Piercer 62 has a sharp end 68 and a blunt end 70. Sharp end 68 is located adjacent sealed opening 42 of neck 40 and is configured for piercing therethrough, such piercing thereby initiating a gas flow 72 (shown schematically, in FIG. 3) from gas cartridge 38. Sharp end 68 of piercer 62 is biased away from sealed opening 42 by a spring 74.

Hammer 64 is slidably positioned within hammer sleeve 76, manifold 56 and manifold lid 58. Specifically, hammer head 78 is slidable along hammer sleeve 76, and hammer stem 80 is slidable within manifold 56, through stem hole 81, and manifold lid 58. Hammer spring 82, which is positioned between hammer head 78 and manifold 56, provides the momentum necessary, when released, to drive hammer head 78 at blunt end 70 of piercer 62 and to thereby drive sharp end 68 thereof into sealed opening 42 of gas cartridge neck 40, allowing gas flow 72 to emanate from gas cartridge 38.

Hammer stem 80 has a notch 84 therein for receiving trigger catch 86. Hammer stem 80 is also provided with a pull ring 88 for pulling hammer 64 into a reset position in which trigger catch 86 engages with notch 84. Hammer stem 80 is further provided with a safety clip hole 90 for receiving safety clip 92 therein (shown assembled in FIG. 1) to prevent unwanted firing of hammer 64 against piercer 62. Safety clip 92 is preferably tethered (not shown) to war games land mine 20 to prevent the loss of safety clip 92 when not attached to hammer stem 80.

Figure 5:
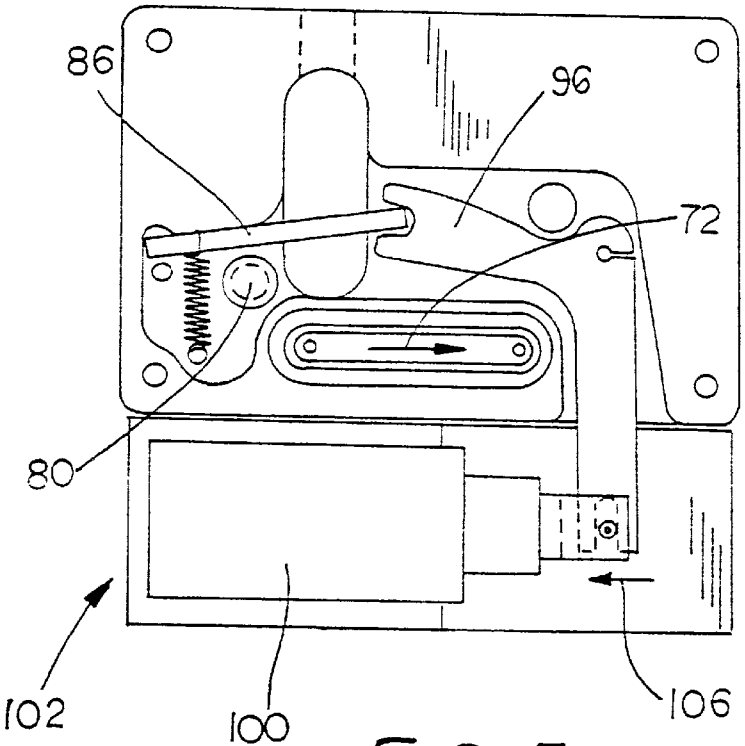
FIG. 5 is a sectional view taken along line 5—5 in FIG. 3, showing the trigger catch in the fired position.
Figure 4:
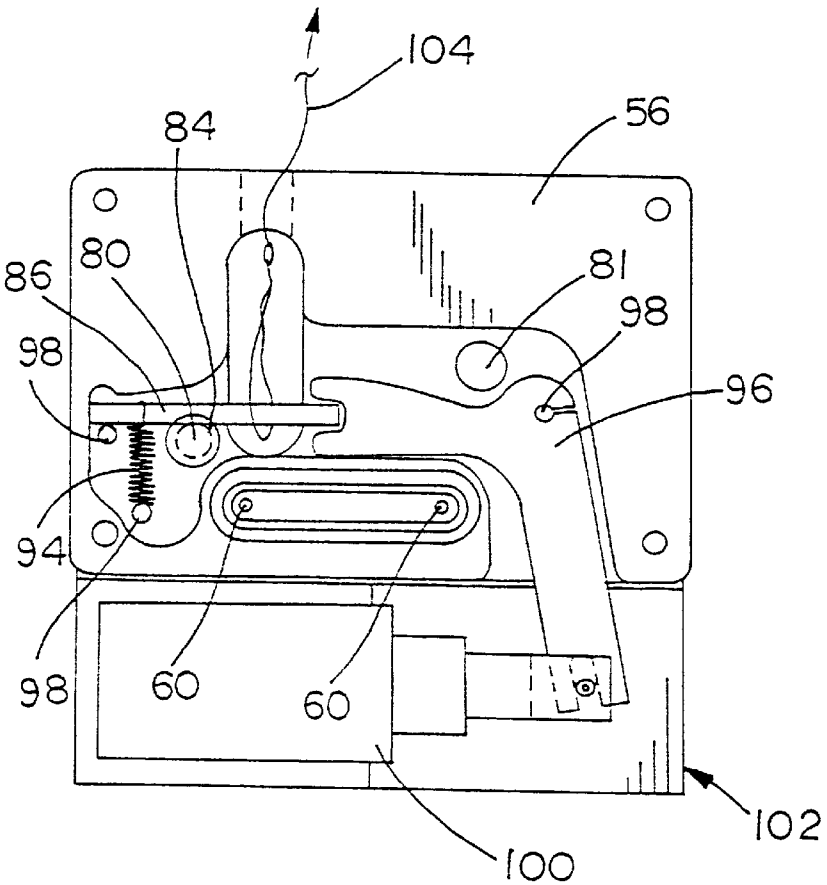
FIG. 4 is a sectional view taken along line 4—4 in FIG. 2, showing the trigger catch in the unfired position.

Trigger catch 86 and the mechanisms related to its movement are best seen in FIGS. 4 and 5, which are sectional views of FIGS. 2 and 3, respectively. Trigger catch 86, as shown in FIG. 4, is held against notch 84 of hammer stem 80 by the coaction of tension spring 94 and solenoid trigger 96. Steel pins 98 are used to aid in the positioning of each of trigger catch 86, tension spring 94 and solenoid trigger 96. Solenoid trigger 96 is coupled with a solenoid 100 which acts as a biasing device therefor. Solenoid 100 is positioned within an electronics control module (ECM) 102, ECM 102 being mounted below gas-release module 22 and marker-source module 24.

Figure 6:
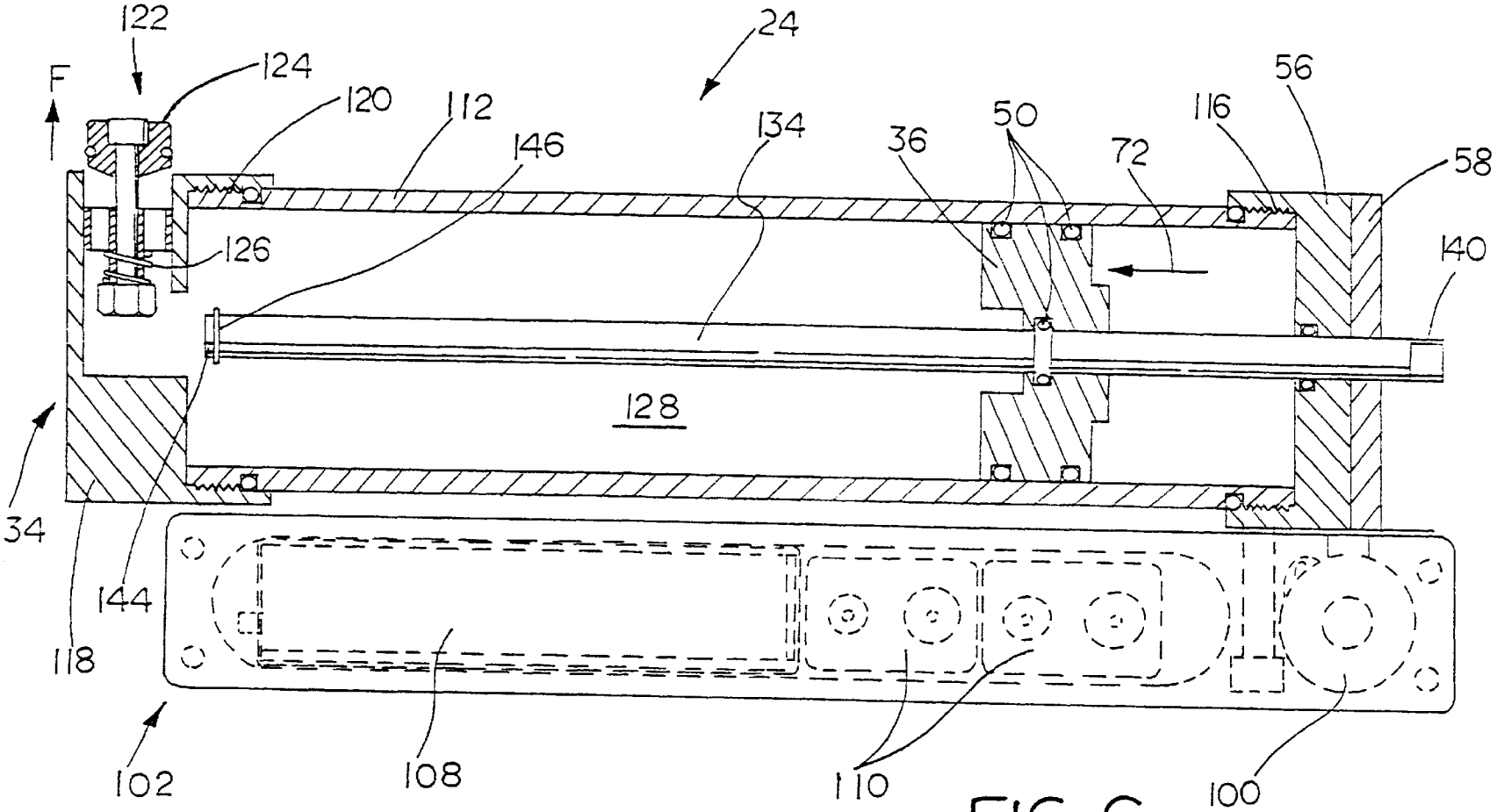
FIG. 6 is a cut-away view taken along line 6—6 in FIG. 1.
Figures 7, 10:
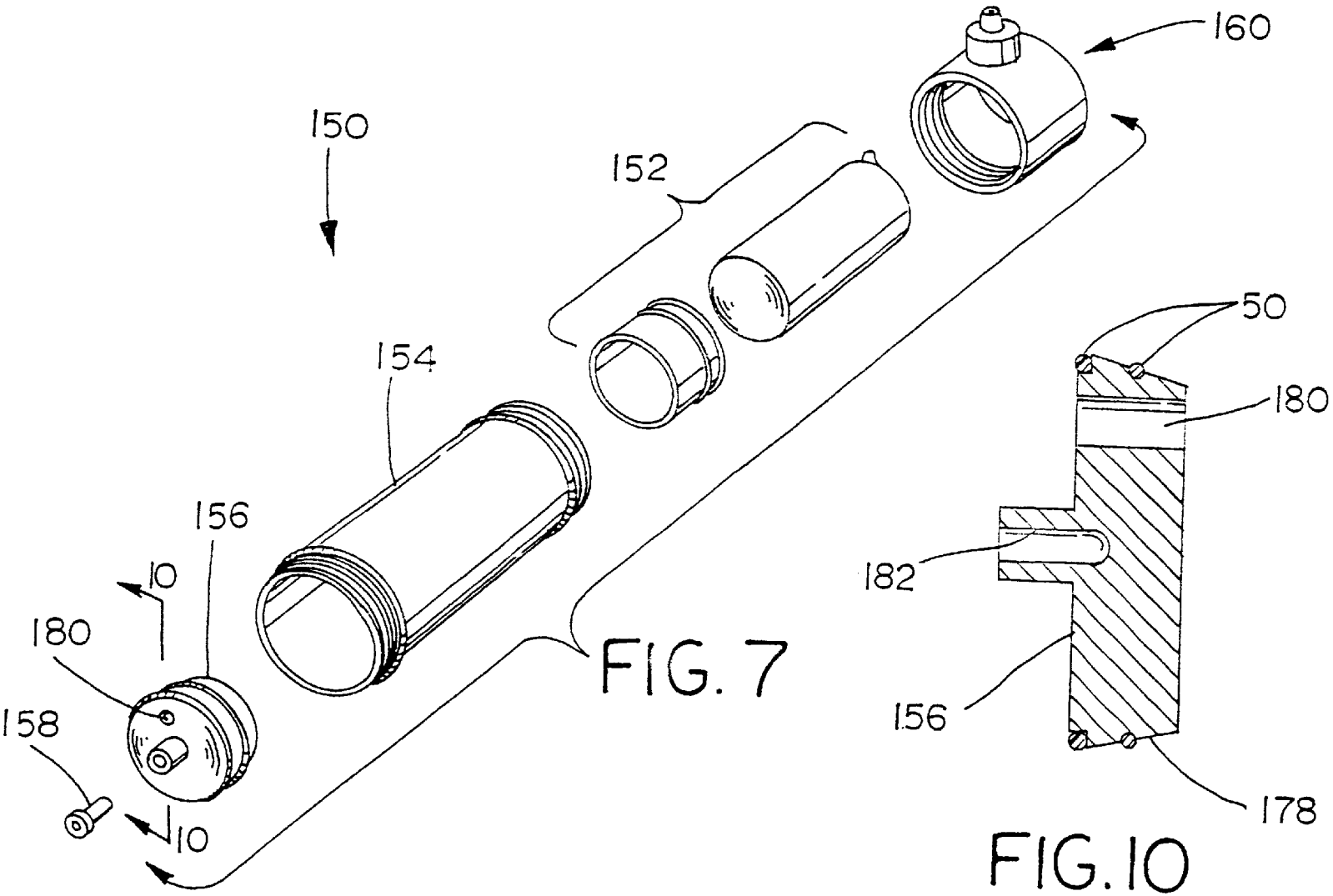
FIG. 7 is an exploded view of an alternate embodiment of a marker-source module of the present invention, featuring a disposable marker agent cartridge.
FIG. 10 is a sectional view taken along line 10—10 in FIG. 7.

Trigger catch 86 may be released from notch 84, thereby allowing hammer 64 to be activated, either mechanically by use of a trip wire 104 (FIGS. 1 and 4) or by a reverse operation of solenoid 100, as indicated schematically by arrow 106 in FIG. 5. A reverse operation of solenoid 100 may be initiated by a motion sensor, a proximity sensor, a radio frequency transmitter/receiver and/or a timer incorporated in and/or associated circuit board 108 (FIG. 6) of ECM 102. Solenoid 100 and circuit board 108 are preferably powered by a pair of nine volt batteries 110. Solenoid 100, circuit board 108 and nine volt batteries 110 are each shown in phantom in FIG. 6.

Marker-source module housing 26 is defined by primary cylinder 112, manifold 56 and manifold lid 58, the three of which together define a second gas channel 114. First gas channel 60 and second gas channel 114 come in direct fluid communication with one another in a region between manifold 56 and manifold lid 58, thereby allowing gas flow 72 to proceed from gas-release module 22 into marker-source module 24. First end 116, having a first orifice 117, of primary cylinder 112 is preferably threadingly connected to manifold 56. Primary cylinder 112 essentially functions as a housing and a container so it is contemplated that other appropriate housing configurations could be employed.

Delivery nozzle 34 includes a cap 118 and a spray release mechanism 122. Cap 118 is connectable to second end 120, having a second orifice 121, of primary cylinder 112, preferably by screw threading, as shown schematically in FIG. 6. Spray release mechanism 122 includes a spray deflector 124 and a deflector biasing spring 126. Spray deflector 124 may be designed to create one or more streams or sprays at angles ranging from 1 to 360°. Deflector biasing spring 126 tends to bias spray deflector 124 into a closed position within delivery nozzle 34. The presence of a force F is needed to overcome that bias and to cause spray release mechanism 122 to activate and thereby permit release of a marking agent 128. Alternatively, marking agent 128 could be directly ejected out of second orifice 121 of second end 120, second orifice 121 having a diameter equal to or less than that of second end 120.

Marking agent 128 is composed of at least one of a marking fluid and a marking slurry. Marking agent 128 is preferably water or a washable paint. Piston 36 has a first piston side 130 and a second piston side 132. Marking agent 128 is contained within primary cylinder 112 in a volume or marker chamber 131 defined at one end by cap 118 and at another end by second piston side 132 of piston 36.

First piston side 130 is in fluid communication with second gas channel 114 and is thereby in the pathway of gas flow 72 upon release of gas from gas cartridge 38. Primary cylinder 112 and first piston side 130 together form a gas chamber 133 for receiving gas flow 72. Impingement of gas flow 72 upon first piston side 130 causes piston 36 to move towards delivery nozzle 34, ultimately creating a sufficient force F upon spray deflector 124 to overcome deflector biasing spring 126, resulting in the outward release of marking agent 128 through spray release mechanism 122. The provision of O-rings 50 within piston 36 helps to ensure that no marking agent 128 leaks back into second gas channel 114. Conversely, O-rings 50 in piston 36 also help to minimize, if not prevent, unwanted leakage of gas flow 72 around piston 36, thereby helping to maximize the amount of force with which gas flow 72 is able to impact first piston side 130.

Marker-source module 24 may be further provided with a reset rod 134 for resetting piston 36 from its "as fired" position 136, as shown in FIG. 3, to its "loaded" position 138, as shown in FIG. 2. Reset rod 134 is preferably provided on its exterior end 140 with a knob 142 to aid in pulling piston 36 to its "loaded" or reset position 138. Interior end 144 of reset rod 134 has a clip 146 mounted thereto to allow reset rod 134 to engage with second piston side 132 during reset of piston 36. Upon resetting, cap 118 of delivery nozzle 34 can be removed from primary cylinder 112 to allow refilling thereof with marking agent 128 and then reaffixed to primary cylinder 112.

An alternative marker-source module housing 150 is shown in FIGS. 7–10. Marker-source module 150 includes a disposable marker cartridge 152, a primary cylinder 154, an adapter 156, a retainer bolt 158 and a delivery nozzle 160. Primary cylinder 154 and delivery nozzle 160 are similar in structure and function to primary cylinder 112 and delivery nozzle 34, respectively, of the first embodiment and thus are not discussed in great detail with regard to this embodiment.

Figure 9:
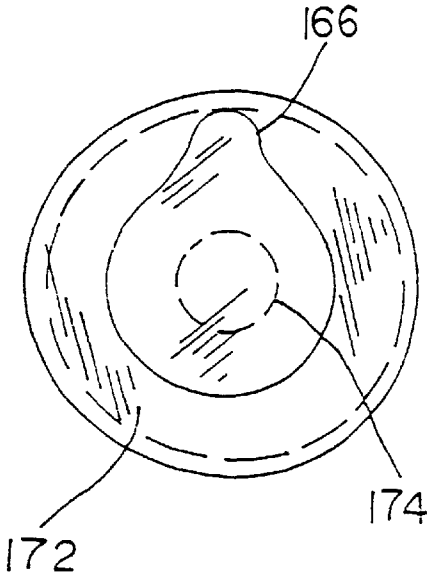
FIG. 9 is an end view of the disposable marker agent cartridge of FIG. 7.
Figure 8:
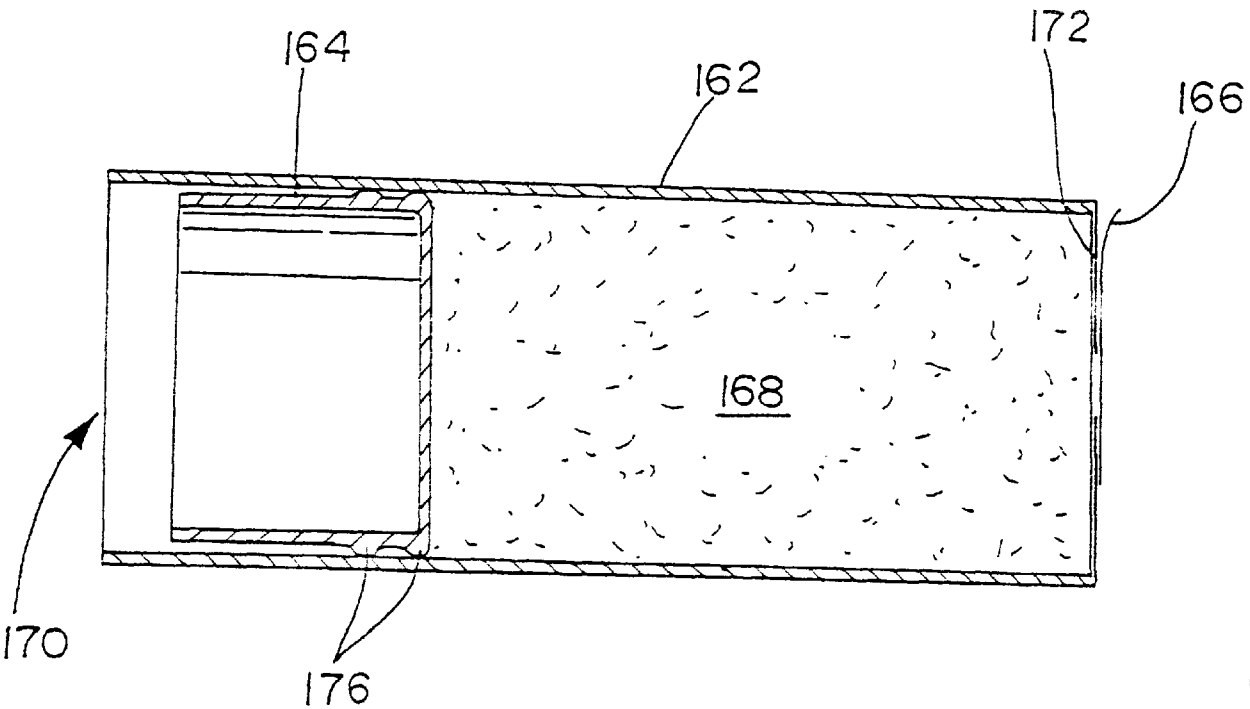
FIG. 8 is a cross-sectional view of the disposable marker agent cartridge of FIG. 7.

Disposable marker cartridge 152, as best seen in FIG. 8, includes a disposable cylinder 162, a disposable piston 164 and a pull-tab seal 166, with a marking agent 168 therein. Disposable cylinder 162 is sized so as to fit within and against primary cylinder 154. Disposable cylinder 162 is provided with an open end 170 into which disposable piston 164 is sealingly and slidably received. Delivery end 172 of disposable cylinder 162 has a delivery hole 174 therein, as best shown in FIG. 9, through which marking agent 168 may reach delivery nozzle 160. Delivery hole 174 is covered by pull-tab seal 166 during storage and delivery, with pull-tab seal 166 being removed prior to insertion of disposable marker cartridge 152 into marker-source module 150.

Disposable piston 164 has a hollow cup shape. Disposable piston 164 is provided with at least one rounded ridge 176 which permits a relatively small portion of the surface area of disposable piston 164 to actually be in contact with disposable cylinder 162 while still achieving a sufficient seal therebetween.

Adaptor 156 permits various size disposable cylinders 162 to be sealingly connected with manifold 56. Adaptor taper 178 accommodates such size variation. Adapter 156 is provided with a gas-flow hole 180 to permit gas to flow from manifold 56 into disposable cylinder 162 and toward disposable piston 164. Adaptor 156 is further provided with a tap seat 182 for receiving retainer bolt 158 via which adaptor 156 can be releasably fixed to and in proper alignment with manifold 56.

ECM 102 may allow for a variety of electronic features to be added on or included therein. An electronic display for displaying information or a buzzer for audibilizing information may be provided. A timer function would permit the automatic firing of the unit. A radio frequency transmitter may generate more than one code for firing of more than one land mine. A transceiver may also be adopted for sending and receiving RF signals. The transceiver could be further used to allow communication between players on the field as well as being used as a firing device. A servo-motor can substitute for the solenoid for activating the trigger. The servo-motor, having positional accuracy, may also activate another device other than the trigger.

The electronic housing (not labelled) of ECM 102 would preferably be molded of plastic. The molded housing may then incorporate a power switch for more economical manufacture. External contacts may be provided for another device or for a device-to-device physical connection.

Figure 11:
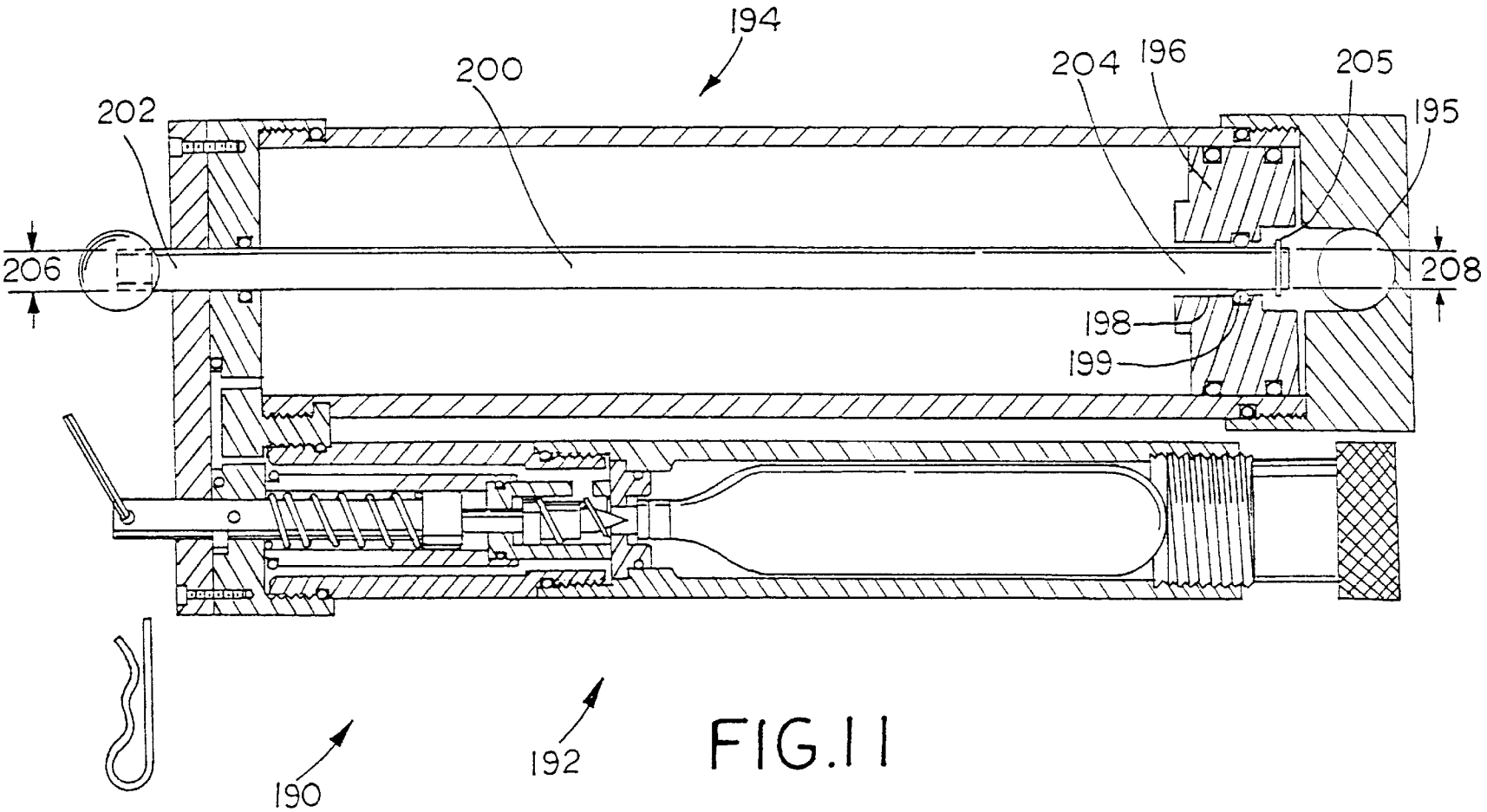
FIG. 11 is a cut-away view of an alternate embodiment of a war games land mine in an as-fired condition.

In another alternate embodiment, war games land mine 190 (FIG. 11) is shown in an as-fired condition. War games land mine 190 has a gas-release module 192 and a marker-source module 194, the latter including a nozzle 195. Gas-release module 192 is equipped and functions similar to gas-release module 22 and is not described in further detail with respect to this embodiment. Further, marker-source module 194 is equipped and functions similar to marker-source module 24 except for those details expressly described herewith. Specifically, piston 196 has piston hole 198 with an O-ring 199 positioned therein. Reset rod 200 extends through piston hole 198 during a firing and reset sequence. Reset rod 200 has an exterior end 202 and an interior end 204, interior end 204 having an associated retaining clip 205 (retaining clip 205 being configured similar to clip 146). Reset rod 200 has a primary diameter 206 beginning at exterior end 202 and extending to, but not including, interior end 204. At least a portion of interior end 204 instead has a secondary diameter 208 which is slightly less than primary diameter 206. Primary diameter 206 is chosen so as to result in an essentially gas-tight seal with piston hole 198 and O-ring 199 yet to allow relatively easy movement of piston 196 upon reset rod 200. However, at interior end 204, a gas-tight seal between piston hole 198, O-ring 199 and reset rod 200 does not exist due to the gap therebetween resulting from secondary diameter 208 being less than primary diameter 206. Consequently, at the end of a firing cycle, i.e. when piston 196 reaches interior end 204 of reset rod 200, gas used for the firing sequence can escape beyond piston 199 and outward through nozzle 195.

Figure 12:
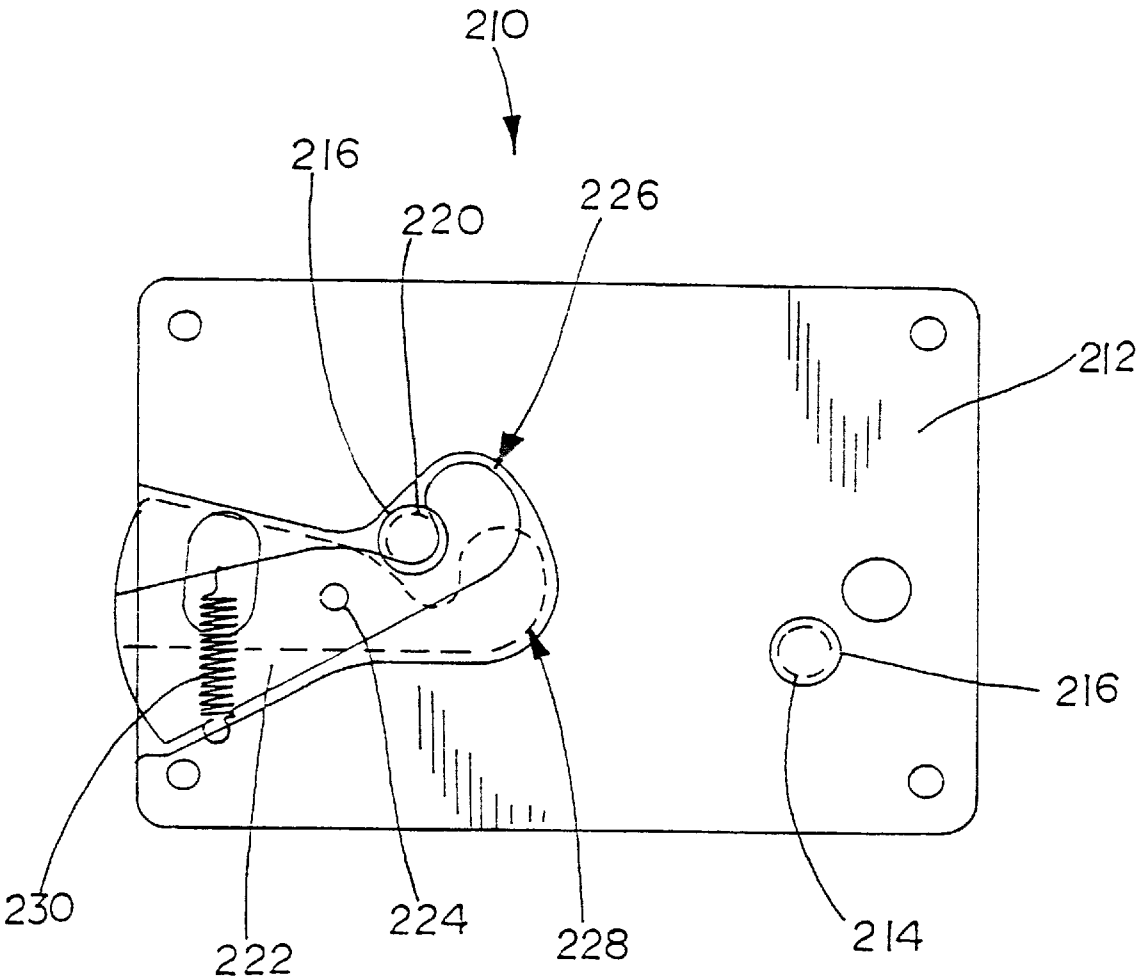
FIG. 12 is a cut-away end view of yet another alternate embodiment of a war games land mine, as viewed toward the manifold lid.

In yet a further embodiment, war games land mine 210 (FIG. 12) is shown from a cut-away end view along a plane between a manifold (not shown) and manifold lid 212. War games land mine 210 includes both a hammer stem 214 and a reset or piston rod 216, with hammer stem 214 also having a corresponding hammer notch 218 therein. Hammer stem 214 and hammer notch 218 are structured and function similar to hammer stem 80 and notch 84 and, thus, are not discussed in further detail here. However, reset rod 216 is provided with a reset notch 220 and has a reset rod stabilizer 222 associated therewith. Reset rod stabilizer 222 is pivotally positioned upon pin 224 (upon which pin 224 a solenoid trigger (not shown in this embodiment) is also positioned and pivots about). Reset rod stabilizer 222 has a stabilizer set position 226 and a stabilizer release position 228 (shown in phantom in FIG. 12). Reset rod stabilizer 222 has a stabilizer spring 230 associated therewith, and when in stabilizer set position 226, reset rod stabilizer 222 is biased into reset notch 220 by stabilizer spring 230. Reset rod stabilizer 222 is kept in stabilizer set position 226 during the firing sequence to help restrict the movement of and thereby stabilize the positioning of reset rod 216 through the turbulence created by the firing sequence.

War games land mine 20 is operated in the following manner. Trigger assembly 30 is activated in order to release the gas from gas source 28 and into first gas channel 60. The gas thereby flows from first gas channel 60 into second gas channel 114. Upon flowing into second gas channel 114, the gas impacts upon first piston side 130 of piston 36. Piston 36 is moved as a result of the impaction of the gas upon first piston side 130, thereby actuating second piston side 132 against marking agent 128. Second piston side 132 impacts against marking agent 128 with a sufficient force to cause at least a substantial portion of marking agent 128 to thereby be expelled through delivery nozzle 34, causing a spray or stream of marking agent 128 to emanate therefrom.

Various other alternative features (not shown) are possible. Nozzle 34 may be a single-hole nozzle having a servo-controlled axial latitude and longitude, operable from an RF transmitter. Additionally, the orifice size and/or flow of fluid from nozzle 34 may be regulated manually or by servo. The flow is restricted by varying how much of the flow passage is blocked by a movable gate. With respect to trigger assembly 30, solenoid 100 itself may be used to provide the energy for piercing gas cartridge 38 by axially aligning the two, using a solenoid of the push-type variety. Furthermore, gas cartridge receiver 44, cartridge seat 46 and main trigger housing 54 could be combined into one unitary part as so could piercer housing 66 and hammer sleeve 76. Separate parts were used in the first embodiment due to ease of manufacture. Reset rod 134, although easing piston reset, is not required therefor. Reset rod 134 is also not necessary when using disposable marker cartridge 152.

Instead of gas cartridge 38 as the gas source, a compressed gas system, such as a larger bottle or a compressed air system, incorporating a valve release, could be used. In such an instance, a valve release mechanism would be used as part of the trigger assembly instead of a piercer assembly. A yet further alternative would be to replace gas source 28 with another pressurized fluid source.

In general, many components of this product would ideally be made of plastic, aluminum or other material that is inexpensive; readily formed and/or machined; and both mechanically and chemically durable. Additionally, such components may be made by any of a variety of appropriate manufacturing methods.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A war games land mine, comprising:

a gas-release module, including:

a gas-release module housing, said gas-release module housing defining a first gas-flow pathway therein;

a gas source mounted within said gas-release module housing and having a gas under pressure therein, said first gas-flow pathway extending to said gas source; and a trigger assembly positioned in association with said gas source and configured for releasing said gas from said gas source and into said first gas-flow pathway; and a marker-source module positioned in association with said gas-release module, said marker-source module including:

a marker-source module housing defining a second gas-flow pathway therein, said second gas-flow pathway being in fluid communication with said first gas-flow pathway and thereby being configured to receive said gas released from said gas source, said marker-source housing including a primary container, said primary container configured for retaining at least one marking agent therein, said primary container having a delivery nozzle fluidly coupled therewith proximate a distal end thereof;

a piston movably mounted in said primary container, said piston defining one end of a containment region for the at least one marking agent within said primary container, said piston having a first piston side and a second piston side, said second piston side being configured to be positioned adjacent the at least one marking agent and to be actuatable thereagainst, said first piston side being in fluid communication with said second gas-flow pathway, said first piston side thereby being configured to be impacted by said gas released from said gas source in a manner sufficient to cause at least a substantial portion of the at least one marking agent to be expelled through said delivery nozzle; and a plurality of o-rings between said piston and said primary container, said plurality of o-rings encompassing said piston, said plurality of o-rings engaging both said piston and said primary container.

2. The war games land mine of claim 1, wherein said gas source is comprised of a gas cartridge containing said gas therein, said gas cartridge having a first cartridge end, said trigger assembly including a piercer and a piercer driver, said piercer having a sharp end positioned adjacent said first cartridge end and an opposing blunt end, said piercer driver configured for impacting said blunt end of said piercer and for thereby propelling said sharp end of said piercer into said first cartridge end to create a hole therein to release said gas from within said gas cartridge.

3. The war games land mine of claim 2, wherein said gas-release module housing has a first cartridge end seat and a piercer driver housing positioned therein, a piercer housing being located between said first cartridge end seat and said piercer driver housing, said first cartridge end being mounted in said first cartridge end seat, said piercer being slidably movable toward and away from said first cartridge end within said piercer housing, said piercer driver being drivingly movable toward said piercer driver housing.

4. The war games land mine of claim 3, wherein said piercer driver includes a driver spring configured for propelling said piercer driver toward said piercer, said piercer driver further including a driver spring release mechanism configured for selectively permitting said driver spring to expand and thereby propel said piercer driver toward said piercer.

5. The war games land mine of claim 4, wherein said driver release mechanism has at least one release activator associated therewith for permitting said driver spring to expand, each release activator being one of a trip wire, a motion sensor, a proximity sensor, a radio frequency transmitter, a timer and an electronic controller.

6. The war games land mine of claim 5, wherein said piercer driver is further configured to be pulled in order to compress said driver spring and configured for coacting with said driver release mechanism to hold said driver spring under compression.

7. The war games land mine of claim 5, wherein said driver release mechanism is mechanically coupled with a solenoid, said solenoid biasing said driver release mechanism toward said piercer driver, said piercer driver having a notch therein into which said driver release mechanism is configured to be biased to thereby hold said driver spring under compression.

8. The war games land mine of claim 1, further comprising an electronics control module mounted adjacent to said gas-release module and to said marker-source module, said electronics control module being configured for controlling at least one of said trigger assembly and said delivery nozzle.

9. The war games land mine of claim 1, wherein each at least one marking agent is one of water and paint.

10. A war games land mine, comprising:

a gas-release module, including:

a gas-release module housing, said gas-release module housing defining a first gas-flow pathway therein;

a gas source mounted within said gas-release module housing and having a gas under pressure therein, said first gas-flow pathway extending to said gas source; and a trigger assembly positioned in association with said gas source and configured for releasing said gas from said gas source and into said first gas-flow pathway; and a marker-source module positioned in association with said gas-release module, said marker-source module including:

a marker-source module housing defining a second gas-flow pathway therein, said second gas-flow pathway being in fluid communication with said first gas-flow pathway and thereby being configured to receive said gas released from said gas source, said marker-source housing including a primary container, said primary container configured for retaining at least one marking agent therein, said primary container having a delivery nozzle fluidly coupled therewith proximate a distal end thereof; and a piston movably mounted in said primary container, said piston defining one end of a containment region for the at least one marking agent within said primary container, said piston having a first piston side and a second piston side, said second piston side being configured to be positioned adjacent the at least one marking agent and to be actuatable thereagainst, said first piston side being in fluid communication with said second gas-flow pathway, said first piston side thereby being configured to be impacted by said gas released from said gas source in a manner sufficient to cause at least a substantial portion of the at least one marking agent to be expelled through said delivery nozzle;

wherein said delivery nozzle is comprised of a cap, said cap being releasably attached to said distal end of said primary container, said cap having a delivery opening therein, said delivery opening having a spring-loaded deflector movably mounted therein, said spring-loaded deflector being biased into said delivery opening for restricting flow therefrom, said spring-loaded deflector being configured for releasing at least one of a spray and a stream of the at least one marking agent upon actuation of said second piston side against the at least one marking agent.

11. A war games land mine, comprising:

a gas-release module, including:

a gas-release module housing, said gas-release module housing defining a first gas-flow pathway therein;

a gas source mounted within said gas-release module housing and having a gas under pressure therein, said first gas-flow pathway extending to said gas source; and a trigger assembly positioned in association with said gas source and configured for releasing said gas from said gas source and into said first gas-flow pathway; and a marker-source module positioned in association with said gas-release module, said marker-source module including:

a marker-source module housing defining a second gas-flow pathway therein, said second gas-flow pathway being in fluid communication with said first gas-flow pathway and thereby being configured to receive said gas released from said gas source, said marker-source housing including a primary container, said primary container configured for retaining at least one marking agent therein, said primary container having a delivery nozzle fluidly coupled therewith proximate a distal end thereof; and a piston movably mounted in said primary container, said piston defining one end of a containment region for the at least one marking agent within said primary container, said piston having a first piston side and a second piston side, said second piston side being configured to be positioned adjacent the at least one marking agent and to be actuatable thereagainst, said first piston side being in fluid communication with said second gas-flow pathway, said first piston side thereby being configured to be impacted by said gas released from said gas source in a manner sufficient to cause at least a substantial portion of the at least one marking agent to be expelled through said delivery nozzle;

wherein said marker-source module housing has an end wall and has a piston rod movably mounted therein, said piston rod extending inside said marker-source module housing and through said piston, said piston being slidably mounted thereupon, said piston rod being configured for moving said piston to a reset position from an as-fired position.

12. The war games land mine of claim 11, wherein said piston rod has an exterior rod end and an interior rod end, said interior rod end extending inside said marker-source module housing and through said piston, said piston rod having a primary rod diameter beginning at said exterior rod end and extending up to about said interior rod end and having a secondary rod diameter, said secondary rod diameter being smaller than said primary rod diameter.

13. The war games land mine of claim 11, wherein said piston rod has a piston rod stabilizer associated therewith, said piston rod stabilizer being configured for being biased against said piston rod.

14. A method of discharging a war games land mine, comprising:

providing a gas-release module, including:

a gas-release module housing, said gas-release module housing defining a first gas-flow pathway therein;

a gas source mounted within said gas-release module housing and having a compressed gas therein, said first gas-flow pathway extending to said gas source; and a trigger assembly positioned adjacent said gas source, said trigger mechanism being configured for releasing said gas from under compression within said gas source and into said first gas-flow pathway; and providing a marker-source module mounted adjacent to said gas-release module, said marker-source module including:

a marker-source module housing defining a second gas-flow pathway therein, said second gas-flow pathway being in fluid communication with said first gas-flow pathway, said marker-source housing including a primary container, said primary container having at least one marking agent therein, said primary container having a delivery nozzle fluidly coupled therewith proximate a distal end thereof;

a piston movably mounted in said primary container, said piston defining one end of a containment region for the at least one marking agent within said primary container, said piston having a first piston side and a second piston side, said first piston side being positioned adjacent the at least one marking agent and being actuatable thereagainst, said second piston side being in fluid communication with said second flow pathway; and a plurality of o-rings between said piston and said primary container, said plurality of o-rings encompassing said piston, said plurality of o-rings engaging both said piston and said primary container;

activating said trigger mechanism in order to release said gas from said gas source and into said first gas-flow pathway, said gas flowing from said first gas-flow pathway into said second gas-flow pathway, said gas impacting upon said said second piston side; and moving said piston via said impacting of said gas upon said second piston side, said first piston side thereby being actuated against the at least one marking agent with a sufficient force to cause at least a substantial portion of the at least one marking agent to be expelled through said delivery nozzle.

* * * * *